US009428714B2

(12) United States Patent
Zander

(10) Patent No.: US 9,428,714 B2
(45) Date of Patent: Aug. 30, 2016

(54) METHOD OF INCREASING THE PERFORMANCE OF CATIONIC FABRIC SOFTENERS

(71) Applicant: The Dial Corporation, Scottsdale, AZ (US)

(72) Inventor: Tasha Zander, Phoenix, AZ (US)

(73) Assignee: The Dial Corporation, Scottsdale, AZ (US)

( * ) Notice: Subject to any disclaimer, the term of this patent is extended or adjusted under 35 U.S.C. 154(b) by 0 days.

(21) Appl. No.: 14/355,290

(22) PCT Filed: Nov. 7, 2012

(86) PCT No.: PCT/US2012/063790

§ 371 (c)(1),
(2) Date: Apr. 30, 2014

(87) PCT Pub. No.: WO2013/070655

PCT Pub. Date: May 16, 2013

(65) Prior Publication Data

US 2014/0315779 A1 Oct. 23, 2014

Related U.S. Application Data

(60) Provisional application No. 61/558,551, filed on Nov. 11, 2011.

(51) Int. Cl.

| | |
|---|---|
| ***C11D 3/37*** | (2006.01) |
| ***C11D 3/00*** | (2006.01) |
| ***D06M 15/267*** | (2006.01) |
| ***D06M 13/463*** | (2006.01) |
| ***C11D 1/62*** | (2006.01) |

(52) U.S. Cl.

CPC ..... *C11D 3/0015* (2013.01); *C11D 1/62* (2013.01); *C11D 3/3773* (2013.01); *D06M 13/463* (2013.01); *D06M 15/267* (2013.01)

(58) Field of Classification Search

CPC ..... C11D 3/3757; C11D 3/0015
USPC ..... 510/522, 527
See application file for complete search history.

(56) References Cited

U.S. PATENT DOCUMENTS

| | | | | |
|---|---|---|---|---|
| 2002/0155983 | A1* | 10/2002 | Grimm | C11D 1/62 510/521 |
| 2008/0242584 | A1* | 10/2008 | Wahl | C11D 3/227 510/517 |
| 2012/0252716 | A1* | 10/2012 | Barnabas | C11D 1/62 510/515 |

* cited by examiner

*Primary Examiner* — John Hardee
(74) *Attorney, Agent, or Firm* — Thomas G. Krivulka

(57) ABSTRACT

The present invention is method of boosting the performance of a cost-reduced liquid fabric softener comprising a quaternary surfactant fabric softener by adding a quaternary (meth) acrylic polymer that functions dually as a fabric softening active and a rheology modifier. In particular, poly[{2-(methacryloyloxy)ethyl}trimethylammonium chloride], poly[{2-(acryloyloxy)ethyl}trimethylammonium chloride], poly[{3-(methacryloyloxy)propyl}trimethylammonium chloride], and poly[{3-(acryloyloxy)propyl}trimethylammonium chloride] provide synergistic fabric softening with quaternary surfactants to provide superior fabric softening scores from cost-optimized compositions.

2 Claims, 2 Drawing Sheets

METHOD OF INCREASING THE PERFORMANCE OF CATIONIC FABRIC SOFTENERS

CROSS-REFERENCE TO RELATED APPLICATIONS

The present application claims priority to International Patent Application No. PCT/US2012/063790, filed Nov. 7, 2012 and entitled "METHOD OF INCREASING THE PERFORMANCE OF CATIONIC FABRIC SOFTENERS" which claims priority to U.S. Provisional Application 61/558,551 filed Nov. 11, 2011 and entitled "METHOD OF INCREASING THE PERFORMANCE OF CATIONIC FABRIC SOFTENERS BY ADDITION OF QUATERNARY (METH)ACRYLIC POLYMERS", which is incorporated herein.

FIELD OF THE INVENTION

The present invention relates to fabric softeners comprising cationic thickeners and in particular to a method of increasing the fabric softening efficacy of a fabric softener by incorporating a quaternary (meth)acrylic polymer. The present invention also relates to the use of a quaternary (meth) acrylic polymer as a fabric softening active.

BACKGROUND OF THE INVENTION

Liquid fabric treatment compositions suitable for fabric softening and static control during the laundry process are well known in the art and widespread in commercial success. These liquid fabric treatment compositions typically contain quaternary ammonium cationic surfactants (commonly referred to as quats, or quaternary fabric softeners) that provide fabric-softening and anti-static benefit during the laundry rinse cycle.

Viscosities are important in formulating both concentrated/premium liquid fabric softeners having high levels of quaternary fabric softener and dilute/discount products having low levels of actives. For concentrated products, electrolytes such as calcium chloride have been used to control viscosity, however addition of up to about 2000 ppm $CaCl_2$ does nothing more than allow a few more percent active quaternary to be added to the formula. This is exemplified in U.S. Pat. No. 3,681,241 (Rudy at al.) wherein formulations comprising only up to about 12% active quaternary are possible. This is also exemplified in U.S. Pat. No. 4,772,404 (Fox et al.) where formulas having up to 15% quaternary blend (Varisoft 222LM and Adogen 442 in a critical ratio) are stabilized with triethanolammonium citrate and 0.09% calcium chloride. Another approach has been to combine fabric "softener" and fabric "substantive" agents. For example U.S. Pat. No. 4,155,855 (Goffinet, et al.), U.S. Pat. No. 4,157,307 (Jaeger et al.) and U.S. Pat. No. 4,855,072 (Trinh et al), describe combination of fabric softening and fabric substantive agents, wherein the fabric substantive agent is a quaternary imidazolinium salt. However, even though the compositions may contain as much as 25-50% of a blend of these two quaternary materials, only the softening agent (a conventional quaternary) appears to confer the softening and antistatic benefit to the fabric.

Other methods to stabilize concentrated fabric softener compositions having high levels of quaternary actives utilize additional surfactants, solvents or polymers. For example, as described in U.S. Pat. No. 4,326,965 (Lips et al.), stable formulas with up to 40% active quaternary are possible when incorporating 4-25% polymer having MW greater than 400.

U.S. Pat. No. 4,556,502 (Blackmore et al.) describes concentrated fabric softener formulations with up to 40% active quaternary if stabilized with greater than 0.5% amphoteric surfactants and 5-30% alkanol solvent. Lastly, U.S. Pat. No. 4,233,164 (Davis) describes stabilization of 2-11% quaternary active formulations through the use of 1-5% nonionic surfactant.

Cost-reduced liquid fabric softeners may comprise lower levels of quaternary surfactant, for example less than about 10 wt. % actives and even less than about 5 wt. % actives. However, these liquids often lack any viscosity and may appear "cheap" to the consumer. Thickeners have been used to give a more "premium" appearance to dilute liquid fabric softeners having low quaternary surfactant active levels. However, some thickeners such as cationic gums and starches are not expected to change the performance of the product, but instead only expected to add cost. Examples of the use of cationic thickeners in fabric softeners is known and may be found in U.S. Pat. No. 6,949,500 (Salesses, et al.) and U.S. Pat. No. 6,514,931 (Grainger, et al.) and U.S. Patent Application Publication 2006/0252668 (Frankenbach, et al.).

Accordingly, additional development of liquid fabric softeners is warranted, ideally with research into thickeners that may bring other benefits to liquid fabric softeners other than viscosity control.

SUMMARY OF THE INVENTION

It has now been surprisingly found that parity fabric softening performance is possible in a cost-reduced fabric softener by the addition of a cationic rheology modifier having quaternary structure. The cationic thickener provides an unexpected fabric softening effect and is much less expensive than quaternary surfactant compounds such as the ester quats typically used as the active softener in liquid fabric softeners.

In a preferred embodiment of the present invention, less than 0.5 wt. % actives cationic polymer or co-polymer derived from at least one quaternized (meth)acrylic monomer boosts the softening performance of a low-actives quat-based fabric softener.

In another preferred embodiment of the present invention, as little as less than 0.5 wt. % actives poly[{2-(methacryloyloxy)ethyl}trimethylammonium chloride] homopolymer boosts the performance of a liquid fabric softener having only 8.0 wt. % actives ester quat softener back up to the softening performance of a liquid composition having 10 wt. % actives quaternary softener and no cationic thickener.

In another preferred embodiment of the present invention, as little as less than 0.5 wt. % actives poly[{3-(methacryloyloxy)propyl}trimethylammonium chloride] homopolymer boosts the performance of a liquid fabric softener having only 8.0 wt. % actives ester quat softener back up to the softening performance of a liquid composition having 10 wt. % actives quaternary softener and no cationic thickener.

In yet another preferred embodiment of the present invention, various quaternized (meth)acrylic polymers, including acylates, methacrylates, acrylamides, and methacrylamides, having quaternized appendages, are used as fabric softening actives.

DETAILED DESCRIPTION OF THE INVENTION

Figure 1:
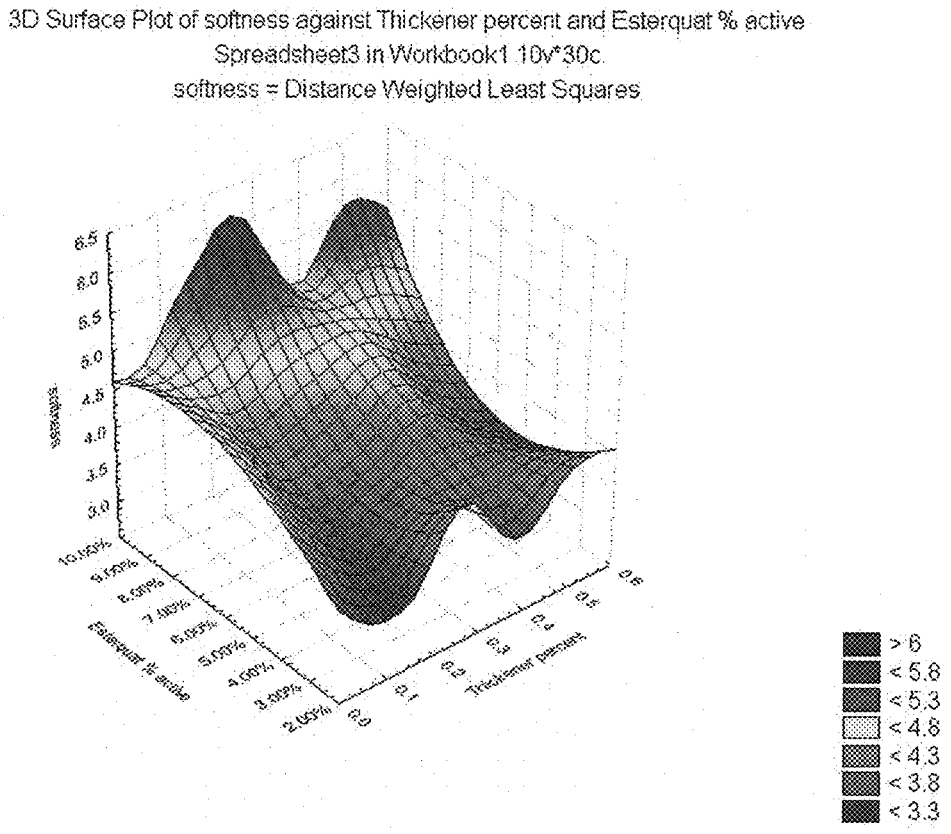
FIG. 1 is a 3D surface plot of fabric softening against cationic thickener and esterquat.

The following description is of exemplary embodiments only and is not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

That said, the present invention relates to a method of increasing the performance of a quat-based liquid fabric softener through the addition of a quaternized poly-(meth)acrylic polymer thickener.

The present invention also relates to fabric softener compositions that minimally comprise quaternary surfactants, a cationic (meth)acrylic polymer thickener, and water, and that optionally comprise antifoams, preservatives, dyes and fragrances.

Quaternary Compounds Useful for Fabric Softening

In accordance with various embodiments of the present invention, the liquid fabric softener compositions comprise a quaternary ammonium cationic surfactant. For brevity, these cationic materials will be referred to as quaternary surfactants with the understanding that they are quaternized nitrogen species (i.e., cationic) and necessarily have an anionic counterion. In this regard, a variety of quaternary surfactants may be utilized. However, acyclic quaternary surfactants are preferred for fabric softener actives. For example, useful quaternary synthetic surfactants that are acyclic include linear alkyl, branched alkyl, hydroxyalkyl, oleylalkyl, acyloxyalkyl, diamidoamine, or diester quaternary ammonium compounds. The preferred quaternary surfactants for use in the present invention are the ester and diester quaternary surfactants and the diamidoamine quaternary blends. Cyclic quaternary materials such as the imidazolines are less preferred in the present invention but remain useful as softener actives. The quaternary surfactant actives in accordance with a preferred embodiment is at a level from about 1% to about 40% by weight of the fabric softener composition, and preferably from about 1% to about 10%, based on the total weight of the composition.

Examples of acyclic quaternary surfactant fabric-softening components useful in the present invention are shown by the general formulas (I) and (II):

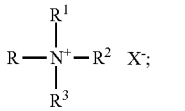

(I)

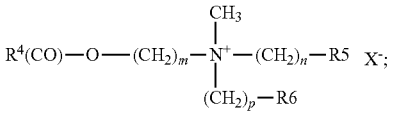

(II)

wherein for general formula (I), R and $R^1$ are individually selected from the group consisting of $C_1$-$C_4$ alkyl, benzyl, and —$(C_2H_4O)_xZ$ where x has a value from 1 to 20 and Z is hydrogen or $C_1$-$C_3$ alkyl; $R^2$ and $R^3$ are each a $C_8$-$C_{30}$ alkyl or $R^2$ is a $C_8$-$C_{30}$ alkyl and $R^3$ is selected from the group consisting of $C_1$-$C_5$ alkyl, benzyl, and —$(C_2H_4O)_x$—H where x has a value from 2 to 5; and where $X^-$ represents an anion selected from the group consisting of halides, methyl sulfate, ethyl sulfate, methyl phosphate, acetate, nitrate or phosphate ion and mixtures thereof. Specific examples of quaternary surfactants described within the general formula (I) include alkyltrimethylammonium compounds, dialkyldimethylammonium compounds and trialkylmethylammonium compounds including but not limited to, tallow trimethyl ammonium chloride, ditallow dimethyl ammonium chloride, ditallow dimethyl ammonium methyl sulfate, dihexadecyl dimethyl ammonium chloride, di-(hydrogenated tallow) dimethyl ammonium chloride, dioctadecyl dimethyl ammonium chloride, dieicosyl dimethyl ammonium chloride, didocosyl dimethyl ammonium chloride, di-(hydrogenated tallow) dimethyl ammonium methyl sulfate, dihexadecyl dimethyl ammonium acetate, ditallow dipropyl ammonium phosphate, ditallow dimethyl ammonium nitrate, di-(coconut-alkyl)dimethyl ammonium chloride, cetyltrimethylammonium chloride, stearyltrimethylammonium chloride, distearyldimethylammonium chloride, lauryldimethylammonium chloride, and tricetylmethylammonium chloride, along with other quaternary compounds such as trihydroxyethylmethylammonium methosulfate, lauryldimethylbenzylammonium chloride, and the like.

Quaternary surfactants of the formula (II) are known as ester quats. Ester quats are notable for excellent biodegradability. In the formula (II), $R^4$ represents an aliphatic alkyl radical of 12 to 22 carbon atoms which has 0, 1, 2 or 3 double bonds; $R^5$ represents H, OH or O—(CO)$R^7$, $R^6$ represents H, OH or O—(CO)$R^8$ independently of $R^5$, with $R^7$ and $R^8$ each being independently an aliphatic alkyl radical of 12 to 22 carbon atoms which has 0, 1, 2 or 3 double bonds. m, n and p are each independently 1, 2 or 3. $X^-$ may be a halide, methyl sulfate, ethyl sulfate, methyl phosphate, nitrate, acetate or phosphate ion and also mixtures thereof. Useful are compounds wherein $R^5$ is O—(CO)$R^7$ and $R^4$ and $R^7$ are alkyl radicals having 16 to 18 carbon atoms, particularly compounds wherein $R^6$ also represents OH. Examples of compounds of the formula (II) include methyl-N-(2-hydroxyethyl)-N,N-di-(tallow acyloxyethyl)ammonium methyl sulfate, bis-(palmitoyl)-ethylhydroxyethyl methyl ammonium methyl sulfate or methyl-N,N-bis(acyloxyethyl)-N-(2-hydroxyethyl)ammonium methyl sulfate. In quaternary surfactants of the formula (II) which comprise unsaturated alkyl chains, preference is given to acyl groups whose corresponding fatty acids have an iodine number between 5 and 80, preferably between 10 and 60 and especially between 15 and 45 and also a cis/trans isomer ratio (in % by weight) of greater than 30:70, preferably greater than 50:50 and especially greater than 70:30. Commercially available examples are the methylhydroxyalkyldialkoyloxyalkylammonium methyl sulfates marketed by Stepan under the Stepantex® brand or the Cognis products appearing under Dehyquart® or the Evonik products appearing under Rewoquat®. Further ester quats of use in the present invention have the formulas; $[(CH_3)_2N^+(CH_2CH_2OC(O)—R)_2]X^-$ or $[(HOCH_2CH_2)(CH_3)N^+(CH_2CH_2OC(O)—R)_2]X^-$, where R=linear saturated or unsaturated alkyl radical of 11 to 19 and preferably 13 to 17 carbon atoms. In a particularly preferred embodiment the fatty acid residues are tallow fatty acid residues. $X^-$ represents either a halide, for example chloride or bromide, methyl phosphate, ethyl phosphate, methyl sulfate, ethyl sulfate, acetate, nitrate, phosphate and also mixtures thereof.

Further useful acyclic quaternary ammonium fabric-softening agents include the diester quats of the formula (III), obtainable under the name Rewoquat® W 222 LM or CR 3099, which provide stability and color protection as well as softness:

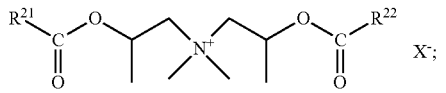

(III)

Wherein $R^{21}$ and $R^{22}$ each independently represent an aliphatic radical of 12 to 22 carbon atoms which has 0, 1, 2 or 3 double bonds.

It is likewise preferable to use amidoamine quaternary surfactants of the formula (IV):

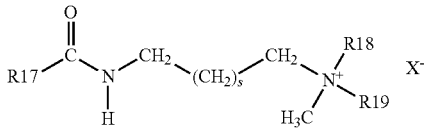

(IV)

wherein $R^{17}$ may be an aliphatic alkyl radical having 12 to 22 carbon atoms with 0, 1, 2 or 3 double bonds, s can assume values between 0 and 5, $R^{18}$ and $R^{19}$ are, independently of one another, each H, $C_{1-4}$-alkyl or hydroxyalkyl. Preferred compounds are fatty acid amidoamines such as stearylamidopropyldimethylamine obtainable under the name Tego Amid® S18, or the 3-tallowamidopropyltrimethylammonium methyl sulfate obtainable under the name Stepantex® X 9124, which are characterized not only by a good conditioning effect, but also by color-transfer-inhibiting effect and in particular by their good biodegradability. Particular preference is given to alkylated quaternary ammonium compounds in which at least one alkyl chain is interrupted by an ester group and/or amido group, in particular N-methyl-N-(2-hydroxyethyl)-N,N-(ditallowacyloxyethyl)ammonium methyl sulfate and/or N-methyl-N-(2-hydroxyethyl)-N,N-(palmitoyloxyethyl)ammonium methyl sulfate.

In preferred embodiments, the present inventive liquid fabric softener compositions comprise Rewoquat® WE-18 (from Evonik), Incrosoft® T-90 from Croda, any of the Stepantex® brand diester quats from Stepan, or any of the Accosoft® diamidoamine quats from Stepan, or mixtures thereof, as the quaternary surfactants, preferably present to achieve a total actives level of from about 1% to about 40 wt. %, and more preferably from 1 wt. % to about 10 wt. %, by weight based on the entire composition.

Cationic Thickener

The cationic thickeners for use in the present invention are quaternary (meth)acrylic polymers having the general structure (V):

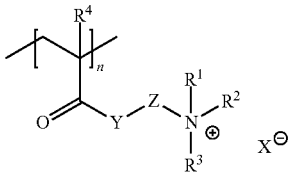

(V)

wherein;

$R^4$ denotes H or $CH_3$;

Y denotes O or NH;

Z denotes: a linear alkyl chain of methylene units ($CH_2$), where x is an integer from 2 to 18; a substituted alkyl chain from 2 to 18 carbons in length having at least one hydroxyl group anywhere along the chain length; a benzene ring wherein the Y and the N substituents attach to the intervening benzene ring in a para relationship; or, a branched alkyl chain having a total number of carbons atoms from 2 to 18 carbon atoms; $R^1$, $R^2$, and $R^3$ are, independently, —$CH_3$, —$CH_2$—$C_6H_5$, —$C_2H_5$, -n-$C_6H_{13}$, -n-$C_{10}H_{21}$, -naphthalenyl, -benzofuranyl, or —$CH_2$—$C_6H_4$—$CH_2$—O—$C_6H_4$—CHO;

X denotes an anion chosen from the group consisting of halides (Cl, Br, I), sulfates (½$SO_4$, $HSO_4$), methosulfate ($MeOSO_3$), trifluoromethane sulfonate (triflate, or "Tf"), tetrafluoroborate ($BF_4$), carbonates, bicarbonates, and mixtures thereof; and n (degree of polymerization) may be between several hundred to about 100 million.

Examples of polymers fitting this general structure (V), and hence useful in the present inventive composition and method, will be discussed below. It's important to note that the polymers for use in the present invention may be homopolymers and/or co-polymers. If the quaternized polymers used herein are co-polymers, the polymer structure may be random or block, with randomly interspersed nonionic monomers or blocks of nonionic oligomers. That is, the quaternary (meth)acrylic structure (V) may be only an oligomeric subunit of a co-polymer that also incorporates nonionic monomers and/or oligomers. Useful polymers are discussed in W. Jaeger, et al., *Progress in Polymer Science,* 35 (2010), 511-577, page 524 of the article, for example the polymers that the authors denote as 54a-h, 54k-m, 55a-f, 56, 57a-c, and 58, along with each of the co-polymers discussed in sections 3.1.3.2 and 3.2 of the article. The polymers and co-polymers disclosed in the Jaeger publication are incorporated herein by reference. Additional discussion of these useful polymers and other useful polymers for the present invention, may be found in U.S. Pat. No. 7,901,697 (Banetti, et al.), U.S. Pat. No. 7,491,753 (Krishnan), U.S. Pat. No. 6,329,483 (Schade, et al.), U.S. Pat. No. 5,608,021 (Uchiyama, et al.), and U.S. Pat. No. 5,169,540 (Fillipo, et al.), each incorporated herein by reference.

As understood in the chemical arts, the term (meth)acrylic is meant to include all acrylate, acrylamide, methacrylate, and methacrylamide substances, which is why the general structure (V) above features variable Y and $R^4$ groups and defines them so as to incorporate each of the acrylate, acrylamide, methacrylate, and methacrylamide polymers. "Quaternized" is the term given to a compound having a nitrogen atom with four (4) appendages and therefore a permanent positive charge. Consequently, there is a negatively charged counterion associated with each quaternized nitrogen atom in the cationic polymer. Synthesis of such quaternized (meth) acrylic polymers is found in the literature and includes, amongst other routes, both the polymerization of pre-quaternized monomers and the quaternization of polymers having appending tri-substituted amino groups with a reactant such as methyl chloride or benzyl chloride.

Preferred quaternary (meth)acrylic polymers for use in the present fabric softener composition include, but are not limited to poly[{2-(methacryloyloxy)ethyl}trimethylammonium chloride], poly[{2-(acryloyloxy)ethyl}trimethylammonium chloride], poly[{3-(methacryloyloxy)propyl}trimethylammonium chloride], poly[{3-(acryloyloxy)propyl}trimethylammonium chloride], poly[{2-(methacrylamido)ethyl}trimethylammonium chloride], poly[{2-(acrylamido)ethyl}trimethylammonium chloride], poly[{3-(methacrylamido)propyl}trimethylammonium chloride], and poly[{3-(acrylamido)propyl}trimethylammonium chloride], and mixtures thereof, each as homopolymers or as block or random co-polymers with various nonionic monomers. Such polymers are available commercially as Polygel® K-200 from 3V Sigma, Rheovis® CDE, CDP, and CSP from CIBA-BASF, and as Zetag™ 7109 from CIBA-BASF, amongst others. The quaternized (meth)acrylic polymers are incorporated in the liquid fabric softener at from about 0.01 wt. % to about 2 wt. % actives, based on the total weight of the composition. Preferably the cationic polymer is used at a level of from about 0.01 wt. % to about 0.5 wt. %. These quaternary (meth) acrylic polymers give an unexpected fabric softening effect and provide a way to cost-optimize liquid fabric softener products by reducing the level of quaternary surfactant and making up for the performance loss by the addition of the polymer. This unexpected benefit of fabric softening allow the use of these quaternary (meth)acrylic polymers as fabric softener actives.

Unsuitable cationic polymers include cationic guar polymers, cationic cellulose derivatives, cationic starches and cationic chitosan derivatives because they do not comprise structural similarity to the quaternary surfactant fabric softeners and are thus not expected to possess dual functionality of fabric softener and rheology modifier.

Optional Ingredients

Inorganic Stabilizers

The present invention may comprise one or more inorganic stabilizers. Such materials include, but are not limited to, calcium chloride and various borates. These inorganic materials are incorporated at from about 0.001 wt. % up to about 1 wt. %, based on the total weight of the composition.

Anti-Foam Agents

Antifoam is an optional ingredient for the compositions of the present invention. Any silicone emulsion antifoam typically used for aqueous compositions finds use in the present invention. Most useful are the antifoam emulsions available from Dow Corning. The preferred silicone antifoam for use in the present invention is Dow Corning® 1430 Antifoam, although Dow Corning® AC-8016 Antifoam, Dow Corning® Q2-3302 Antifoam Compound, Dow Corning® Q2-3425 Antifoam Compound, Dow Corning® DSP Antifoam Emulsion, Dow Corning® BF20 PLUS Antifoam Emulsion, Dow Corning® 544 Antifoam Compound, Dow Corning® DB-310 Antifoam Compound, and Dow Corning® 1520 Silicone Antifoam along with any other similar industrial or food grade silicone defoamer find use in the present invention. These types of materials mentioned help reduce foaming in the rinse cycle of the laundry operation when incorporated in the fabric softener composition. Preferably the antifoam is present in the composition from about 0.0001% to about 0.01% by weight, based on the total weight of the composition.

Antimicrobial Agent

Examples of antimicrobial agents that find use in the present invention include glutaraldehyde, formaldehyde, 2-bromo-2-nitropropane-1,3-diol sold under the trade name Bronopol®, 5-chloro-2-methyl-4-isothiazoline-3-one and 2-methyl-4-isothiazoline-3-one sold under the trade name Kathon®, and mixtures thereof. The preferred level for the antimicrobial is from about 0.001% to about 0.1%, or at that level recommended by the supplier of the particular antimicrobial and/or suggested in the supplier technical literature as that level required for optimally preserving aqueous surfactant compositions from mold and bacterial growth. The preferred antimicrobial for use in the present invention is glutaraldehyde and is best when incorporated from about 0.01% to about 0.10%. Most preferred in the present invention is to use Ucarcide® 250 brand of 50% glutaraldehyde solution and to add it at 0.050% by weight, based on the entire composition, resulting in an active level of glutaraldehyde of about 0.025%.

Fragrances

Fragrance is an optional ingredient for the fabric softener compositions of the present invention. For consumer acceptance, product recognition and recall, and most importantly to impart substantive fragrance to the fabrics inside the laundry washing machine, a fragrance is preferably added to the liquid fabric softener compositions of the present invention. Depending on the strength of the fragrance and the character of the perfume notes, the preferred amount of fragrance is from about 0.01% to about 3% by weight, based on the entire composition. Some preferred fragrances include, but are not limited to, UN063503/00, UN063507/00, UN063506/00, UN063511/00, UN063505/00, and UN063513/00 from Givaudan Fragrances, and Fressia-497 (from International Flavors and Fragrances).

Dyes

Dyes are optional ingredients within the compositions of the present invention. Dyes may comprise pigments, or other colorants, chosen so that they are compatible with the acidic pH of the final composition and such that the color is not attracted to the fabric. For example, a preferred colorant for use in the present invention is Liquitint® Green FS (from Milliken), at from about 0.001% to about 0.01% by weight, based on the entire composition. Other dyes such as C.I. Pigment Green #7, C.I. Reactive Green #12, F D & C Green #3, C.I. Acid Blue #80, C.I. Acid Yellow #17, Liquitint® Red MX, F D & C Yellow #5, Liquitint® Violet LS, Fast Turquise GLL, Liquitint® Blue MC, or mixtures thereof are also useful in the compositions of the present invention.

TABLE 1 delineates non-limiting examples of fabric softening compositions of the present invention, wherein cationic thickeners provide both fabric softening and thickening to the quaternary surfactant-based liquid fabric softener.

TABLE 1

Exemplary Liquid Fabric Softener Compositions

| Ingredients (in weight percent actives) | Formulations | | | | |
|---|---|---|---|---|---|
| | A | B | C | D | E |
| Quaternary surfactant[1] | 10.00 | 4.44 | 6.50 | 8.00 | 9.50 |
| Cationic thickener[2] | 0 | 0.15 | 0.15 | 0.15 | 0.15 |
| Inorganic stabilizers, defoaming agent | + | + | + | + | + |
| Water, fragrance, dyes, preservatives | q.s. | q.s. | q.s. | q.s. | q.s. |
| Total | 100.0 | 100.0 | 100.0 | 100.0 | 100.0 |
| Softening Score | 4.78 | 4.45 | 4.48 | 5.06 | 5.17 |

Table Notes:
[1]Rewoquat ® WE-18 from Evonic;
[2]Polygel ® K-200 from 3V

METHODS, RESULTS AND DISCUSSION

To test softness, approximately 50 cotton washcloths are washed in a washing machine using a typical laundry detergent followed by the test liquid fabric softener in the rinse cycle. The laundered washcloths are subsequently dried in an electric dryer. 12 washcloths are stacked and placed on a table for panelists to feel and rate. The test is run in duplicate and blind. Panelists are asked to rank the level of softness on a scale from 1-9, with 1 being unacceptable and 9 being perfectly soft to the touch. The numbers are averaged and statistically analyzed. The data were also inputted into 3D surface plot DOE to probe for synergies between the fabric softening quaternary surfactant and the cationic quaternary (meth) acrylic polymer thickener.

Figure 2:
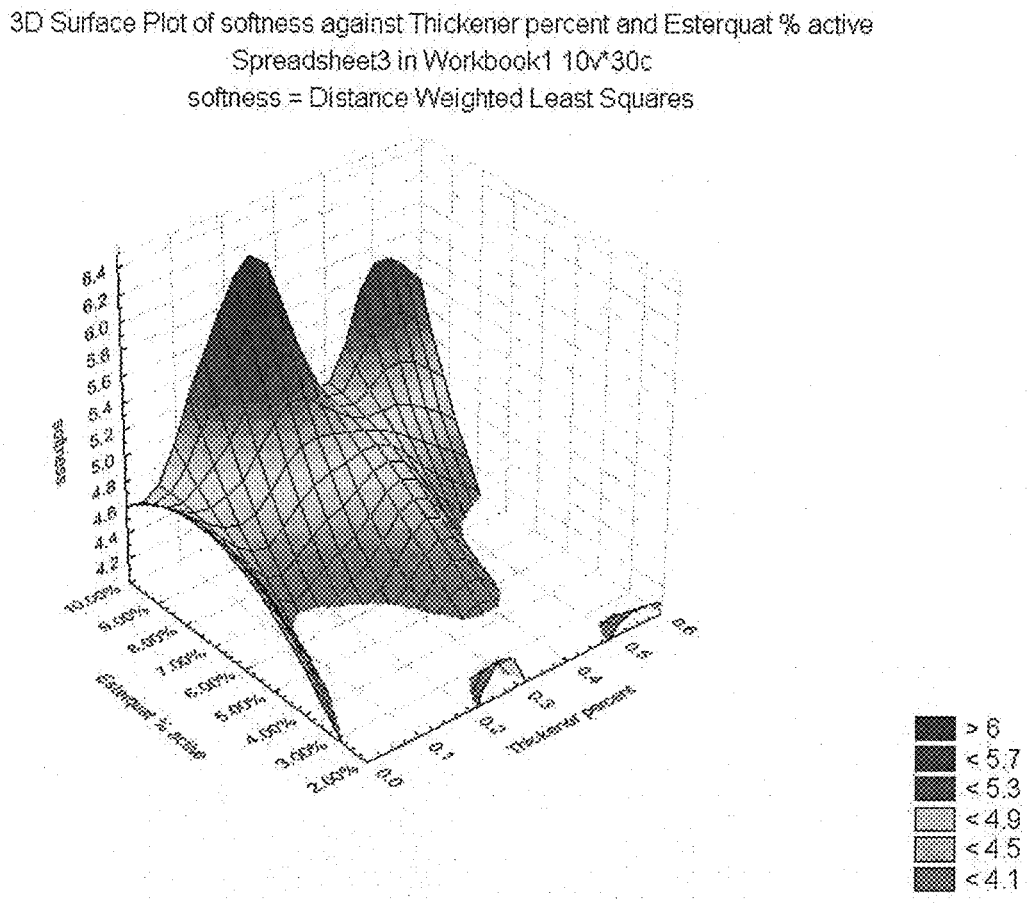
FIG. 2 is also a 3D surface plot of fabric softening against cationic thickener and esterquat.

From analysis of FIGS. 1 and 2, it is evident that quaternary (meth)acrylic thickener functions as a fabric softener. Indeed, even the control formula A having 10% active quat softener and no thickener may be boosted in performance from softness scores of 4.78 up to a theoretical 6.1 by the addition of about 0.25 wt. % quaternary (meth)acrylic polymer. Lower active quat softeners, for example having only about 6.0 wt. % quaternary surfactant actives, may be boosted in performance by addition of only about 0.35 wt. % quaternary (meth)acrylic polymer. As can be seen in the 3D surface plots, it is possible to formulate a cost-reduced liquid fabric softener having only 6.0 wt. % active esterquat and only about 0.35 wt. % actives quaternary (meth)acrylic polymer yet still have softness scores greater than the scores possible with 10 wt. % quaternary surfactant actives and no quaternary (meth)acrylic polymer.

I have thus demonstrated that certain quaternary (meth) acrylic polymers not only function as fabric softeners but actually boost softness performance to such an extent that synergy between the fabric softening quat and the cationic polymer is suggested. Certain quaternary (meth)acrylic polymers may therefore be used as fabric softeners, may be used to boost the performance of low-actives quaternary surfactant-based fabric softeners, all while providing the expected benefit of thickening.

I claim:

1. A liquid fabric softener composition comprising:

a) from 1 to 40 wt. % of dihydrogenated tallowethyl hydroxyethylmonium methosulfate;

b) from 0.01 to 2.0 wt. % of N,N,N-trimethyl-2[methyl-1-oxo-propenyl]oxy-chloride homopolymer; and c) water.

2. A method of increasing the performance of a liquid fabric softener comprising quaternary surfactant and water, said method comprising the steps of:

a) compounding a liquid composition consisting essentially of dehydrogenated tallowethyl hydroxyethylmonium methosulfate and water; and b) adding to said liquid composition N,N,N-trimethyl-2 [methyl-1-oxo-propenyl]oxy-chloride homopolymer.

* * * * *